United States Patent [19]

Kimura et al.

[11] 4,407,222

[45] Oct. 4, 1983

[54] COATING SYSTEM FOR SEMI-FLUID COATING COMPOSITION COMPRISING CEMENT AND AGGREGATE

[75] Inventors: Tadao Kimura; Hideoki Toriyama, both of Iwakunishi, Japan

[73] Assignee: Sanyo-Kokusaku Pulp Co., Ltd., Tokyo, Japan

[21] Appl. No.: 295,067

[22] Filed: Aug. 21, 1981

[51] Int. Cl.[3] ..... B05C 5/00; B05C 11/02

[52] U.S. Cl. ..... 118/110; 118/224

[58] Field of Search ..... 118/119, 308, 118, 324, 118/110; 427/359, 365, 369

[56] References Cited

U.S. PATENT DOCUMENTS 2,309,571 1/1943 Bruce et al. ..... 118/119 X

*Primary Examiner*—Evan K. Lawrence

[57] ABSTRACT

The present invention aims at providing a coating system which is capable of uniformly applying coating materials mixed with aggregates with a low fluidity as well as homogeneity on a base material and at remarkably enhancing productivity in the coating process. The coating system according to the present invention is characterized by the provision of a hopper to contain the coating materials mixed with aggregate arranged at a position so as to place a material outlet port of the hopper above a base material conveyer and of at least one levelling roller which is rotated in the same direction as the advancing direction of the base material, and arranged at a position above said base material conveyer but ahead of said material outlet port in the advancing path of the base material. The levelling roller rotates at a higher peripheral speed than the speed of the base material conveyor.

1 Claim, 2 Drawing Figures

COATING SYSTEM FOR SEMI-FLUID COATING COMPOSITION COMPRISING CEMENT AND AGGREGATE

BACKGROUND OF THE INVENTION

The present invention concerns a coating system wherein a coating material mixture of an inorganic cementing agent, for instance, cement, grains of foamed synthetic resin and water is coated upon a base material to obtain a smooth coating for construction works.

Since coating materials mixed with aggregates of organic or inorganic materials, or wood chips have a low fluidity and lack homogeneity, it has heretofore been extremely difficult to coat such coating materials uniformly on a base and the development of a system which would facilitate uniform coating of such materials has long been desired. For example, the coating works using a roll coater or a knife coater have been found defective in that coating materials could not be evenly coated upon the base materials since coating materials tended to become entangled with or attached to coaters: therefore, the materials had to be limited to aggregates of minute particles. With such coating methods, the amount of aggregates and the thickness of coat inconveniently had to be limited within a narrow range. The coating work using a spray gun is also defective since it is difficult to apply the coating material thickly and it tends to cause pores of the air and the adhesion of the coating materials onto the base materials is not sufficiently strong, thereby presenting unsurmountable difficulties for desired even and uniform coating. Coating using plasterers' trowels requires much skill and experience and the productivity thereof is not very high.

SUMMARY OF THE INVENTION

The present invention aims at eliminating the above mentioned defects and further at providing a coating system which can remarkably enhance productivity as well as enable to uniformly coat. The coating system according to the present invention comprises a hopper which stores coating mixture with aggregates to be supplied on a base material having either a board or a sheet form and which is so positioned that a material outlet port of said hopper comes above a conveyer of said base material, and at least more than one levelling rollers which are rotatable in the same direction as the advancing direction of the base material and at a higher speed than the feeding speed of the base material conveyor and which are located at a position in front of said material outlet port along the advancing direction of the base material and above said conveyer.

DETAILED DESCRIPTION OF PREFERRED EMBODIMENT

The present invention will now be explained referring to an embodiment indicated in attached drawings.

Figure 1:
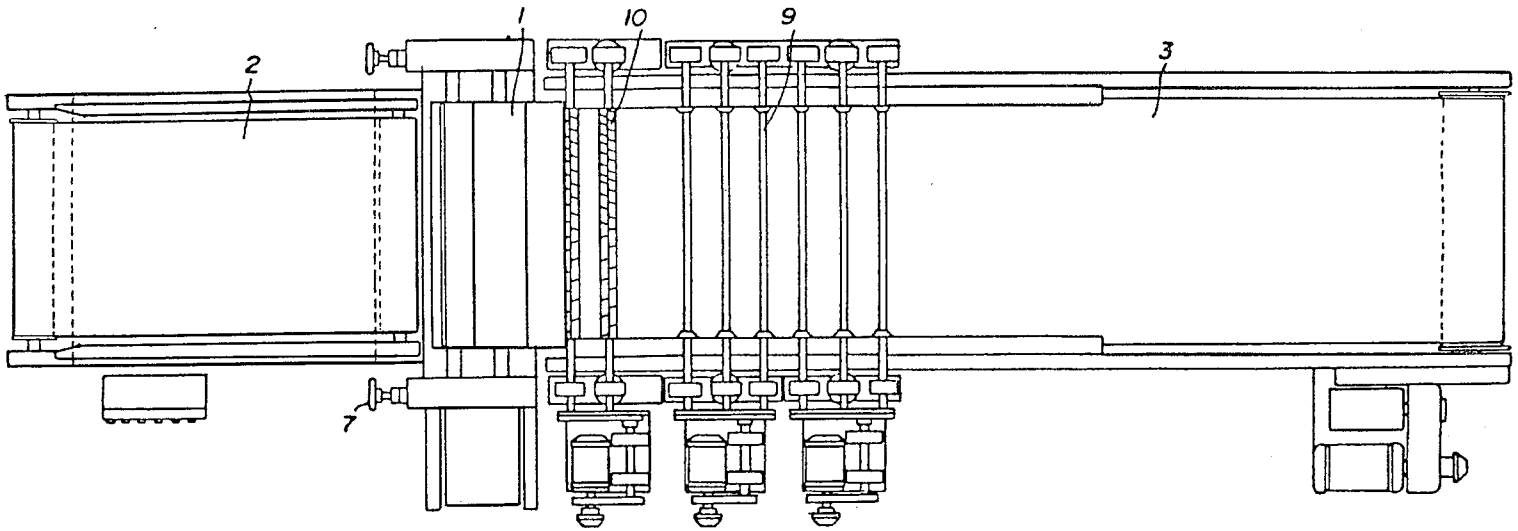
FIG. 1 is a plan view and FIG. 2 a side view respectively of an embodiment according to the present invention.
Figure 2:
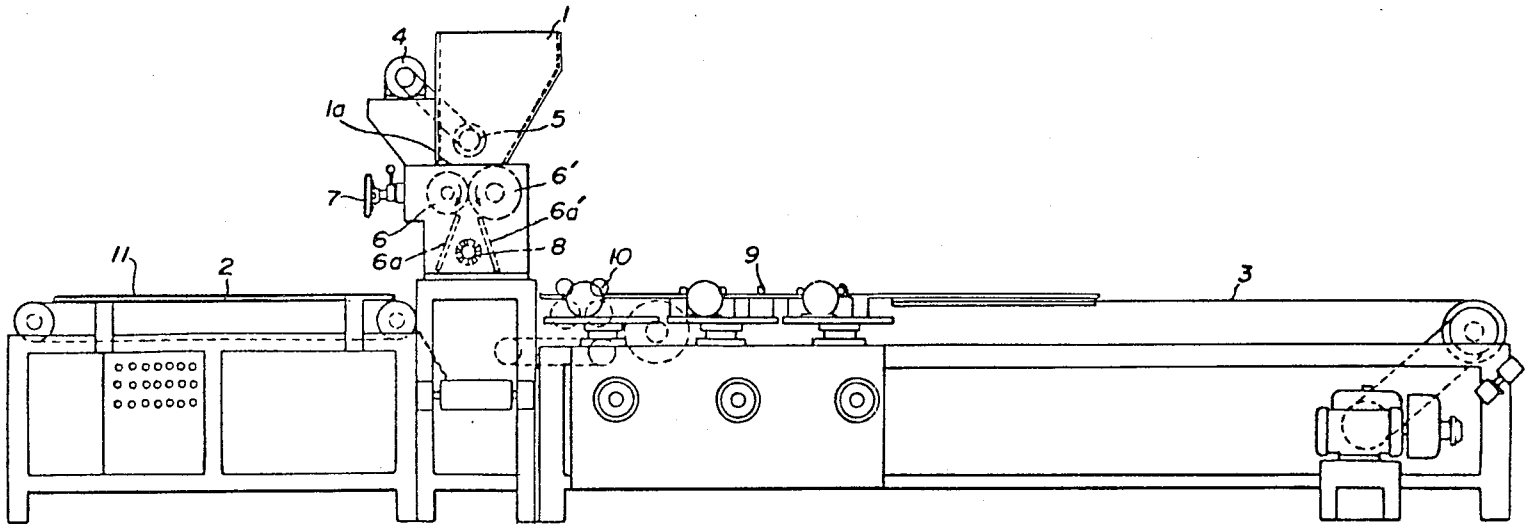

FIG. 1 is a plane view and FIG. 2 a side view respectively showing an embodiment of the present invention wherein the reference numeral 1 denotes a hopper which contains coating material mixtures with aggregates to be supplied on a base material 11 having the form of either a board or a sheet, 2, the first base material conveyer, and 3, a second base material conveyer. The hopper 1 is positioned so that the material outlet port 1*a* thereof comes above the base material conveyors 2 and 3 to ensure that the coating material is supplied from the material outlet port 1*a* upon the base material which is being conveyed on the base material conveyers 2 and 3. In order to sufficiently mix and blend the coating material mixture with aggregates inside the hopper 1, an agitating roller 5 with a large number of pins projected therefrom which are made rotatable by a motor 4 may be used. There may be used a pair of adjusting rollers 6 and 6′ underneath the agitating roller 5 in order to control the amount of one discharge of the coating material. The distance between the adjusting roller 6 and the other adjusting roller 6′ can be adjusted by rotating a handle 7 and the amount of discharging can be determined by the gap thus produced between the rollers 6 and 6′. A pair of doctor's blades 6*a* and 6*a*′ are provided in a form of a pair of herringbone under the adjusting rollers 6 and 6′ in order to scrape off the coating materials attached on the rollers so as to maintain the controlling function for discharge. If a spattering roller 8 is provided under the adjusting rollers 6 and 6′, the materials to be discharged from the material outlet port 1*a* will be conveniently broken up to be evenly supplied on the base material. The mixing roller 5, the adjusting rollers 6 and 6′ and the spattering roller 8 are the components provided for the purpose of evenly coating the aggregate containing coating mixture. Although in the embodiment disclosed in the drawings, the base material conveyer is divided into the first and the second conveyers, the present invention is not to be limited to this structure, but may be of any structure including that of a single conveyer or that of the first and the second conveyers crossing perpendicularly to each other so far as it is designed to position the coating material outlet port above the base material conveyer and it can effectively convey the material.

The base material upon which the aggregate containing mixture coating material has been supplied is further conveyed by the second base material conveyer 3 to proceed to the following levelling process. In the advancing direction of the conveyer and ahead, at least one levelling roller 9 which rotates in the same direction as the advancing direction of the material is provided on the base material conveyer 3. The base material supplied with the coating material is therefore pressed between the base material conveyer 3 and the material levelling rollers 9 from both sides to be coated evenly with the aggregate material. It was found that the diameter of the levelling rollers 9 should preferably be small and more preferably from 10 to 200 mm for effectively conducting the uniform coating. When the roller diameter is less than 10 mm, the levelling rollers do not have sufficient strength, causing distortion or breakage of the rollers. When the roller diameter exceeds 200 mm, on the other hand, the compression area of the rollers becomes too large, reducing the levelling effect of the rollers and brings about an unsatisfactory performance. As disclosed in the drawings, if a width levelling roller 10 is provided in front of the levelling rollers 9, the effect of uniform coating will be further enhanced.

It is preferable to determine the revolution, the diameter and the number of material levelling rollers 9 depending on the composition, blending, etc. of the material. It has been proven that a better result can be obtained if the levelling rollers 9 are rotated at a peripheral speed higher than the feeding speed of the base material conveyer 3. When the peripheral speed is determined to be the rate higher than the feeding speed of the conveyer, the coating material is instantaneously subjected to a predetermined roller pressure and the water content of low viscosity or the solvent content in the coating composition seeps out onto the boundary surface between the coating composition and the roller, and causes a shear at the boundary surface between the roller and the base material. This prevents the coating composition from attaching to the levelling rollers 9 or transferring thereto, thus enabling a continuous and uniform coating.

Examples obtained by using the system according to the present invention are summarized in the following table:

| | Example 1 | Example 2 | Example 3 |
|---|---|---|---|
| Base Material | Plywood (5 × 910 × 1820 mm) | Polyethylene Sheet | Asbestos Slate (6 × 610 × 2740 mm) |
| Coating Blend | Portland Cement 68%<br>Aggregate made of crushed foaming styrol powder and grain 4% (grain size: 4 mm pass)<br>Water 28% | Vermiculite 30% (grain size: 7 mm pass)<br>Pearlite 10% (grain size: 2 mm pass)<br>Water glass 60% | White Portland Cement 29%<br>White Japanese Marble 54% (grain size: 25 mm pass)<br>Water 14%<br>Glass fiber 3% |
| Supply condition | Roughly supplied on the base material by dispersing machine | Roughly supplied. | Roughly supplied. |
| Levelling Roller | 6 rollers of diameter of 25 mm arranged in parallel | 3 rollers of diameter of 80 mm,<br>4 rollers of diameter of 40 mm, arranged in parallel | 5 rollers of diameter of 30 mm arranged in parallel |
| Levelling Condition | Base material feeding speed 20 m/min. Roller peripheral speed 30 m/min. | Base material feeding speed 10 m/min. Roller peripheral speed 15 m/min. (80 mm) 20 m/min. (40 mm) | Base material feeding speed 20 m/min. Roller peripheral speed 35 m/min. |
| Thickness of Coating Materials | 5 mm | 30 mm | 4 mm |
| Evaluation on result | A compound board having dry and even irregularities of aggregates on surface is obtained. | By drying and peeling off a polyethylene sheet, a nonflammable board having uniform inorganic aggregates is obtained | A compound board which is dry and has a surface as finished by plasterers' trowels is obtained. |

As described above referring to the embodiment shown in the drawings, the system according to the present invention uses a roller of a small diameter, more specifically of 10 to 200 mm, in the levelling process, and the coating material is pressed upon the base material in a linear contact by the roller. Therefore, any excess coating material is simply levelled rearward, without being subjected to any excess pressure, and excessive deformation, rehardening or destruction of aggregates are avoided to obtain an evenly coated surface. Since in this system materials are not subjected to excess pressure, it becomes possible to use such aggregates as those easily susceptible to deformation or damages. Further, due to the enhanced levelling effect produced by the rollers of a small diameter, such materials as having a low fluidity or a low dispersion can be used for coating.

By providing a coating material levelling rollers which are rotatable in the same direction as the advancing direction of the base material at a position in front of the outlet port and more particularly levelling rollers which are rotatable at a peripheral speed higher than the feeding speed of the base material conveyer, it becomes possible to coat the coating composition continuously without aforementioned defects such as attachment or transference of composition onto the levelling rollers and further to coat it uniformly and readily on slippery base materials. Since the rollers ensure the close bonding between the coating composition and the base material with the predetermined pressure, airy pores would not be produced and mold releasing films would not be required.

Further by providing at least one levelling roller, the coating composition supplied on the base material out of the outlet port has a higher precision in thickness and homogeneity and, if necessary, can have better smoothness.

The coating system according to the present invention is further advantageous in that an aggregate containing coating composition in a wide scope can be uniformly coated at a desired thickness, or under desired surface conditions by varying the number, the diameter, the height, the material and/or the revolution of the rollers and in that a coated surface having crenellations or notches along the advancing direction can be obtained by varying the shape of the roller surface of the levelling rollers.

What is claimed:

1. A coating system for a semi-fluid coating composition comprising cement and aggregate, characterized in that a hopper containing said coating composition to be supplied on a base material having a sheet form is provided at a position so as to locate a coating composition outlet port of said hopper above a base material conveyor, said base material moving past the hopper on said conveyer, and that at least one levelling roller for leveling said composition having a diameter of 10 to 200 mm is provided above said base material conveyor in front of said material outlet port along the advancing direction of the base material for rotating in the same direction as the advancing direction and at a higher peripheral speed than the speed of the base material conveyor.

* * * * *